United States Patent [19]

Blok et al.

[11] 4,169,565

[45] Oct. 2, 1979

[54] CONTACTLESS WINDING APPARATUS

[75] Inventors: Pieter Blok, Arnhem; Cornelis M. Elenbaas, De Steeg; Anthony E. J. Doyer, Emmen, all of Netherlands

[73] Assignee: Akzona Incorporated, Asheville, N.C.

[21] Appl. No.: 925,573

[22] Filed: Jul. 17, 1978

[30] Foreign Application Priority Data

Jul. 22, 1977 [NL] Netherlands ..... 7708149

[51] Int. Cl.[2] ..... B65H 54/02; B65H 54/28; B65H 59/38

[52] U.S. Cl. ..... 242/18 R; 242/36; 242/43 R; 242/45

[58] Field of Search ..... 242/18 R, 43 R, 18 G, 242/45, 36, 37, 75.51, 39

[56] References Cited

U.S. PATENT DOCUMENTS

| | | | |
|---|---|---|---|
| 3,536,272 | 10/1970 | Ueyama | 242/45 |
| 3,845,912 | 11/1974 | Eichmanns et al. | 242/18 R |
| 3,860,187 | 1/1975 | Liska et al. | 242/45 |
| 3,931,938 | 1/1976 | Hasegawa et al. | 242/45 |

*Primary Examiner*—Stanley N. Gilreath

*Attorney, Agent, or Firm*—Francis W. Young; Tom R. Vestal

[57] ABSTRACT

The invention relates to a device for the winding of yarn on a tube to a yarn package which device is equipped with a traverse unit. The device imparts to the yarn a traverse motion in axial direction with respect to the tube. The circumference of the yarn package is clear of any element. A pneumatic detector located near the circumference of the yarn package pneumatically detects the distance between the circumference of the yarn package and the traverse unit.

20 Claims, 9 Drawing Figures

CONTACTLESS WINDING APPARATUS

STATEMENT OF THE PRIOR ART

In a known winding device, the yarn is imparted its traversing motion by a thread guide which is driven by a traverse roll provided with helical grooves. The traverse mechanism including the thread guide and traverse roll can be moved in a radial direction with respect to the yarn package by a displacement device controlled by a pneumatic detector. The latter is mounted on the traverse mechanism and is provided with one or more openings near the circumference of the yarn package. Air from a compressed air source connected to the detector is emitted from the openings. The air flowing from the detector hits the yarn package and part of this air rebounds onto an air intake opening of the detector which is connected to the displacement device. At a certain minimal distance between the yarn package and traverse mechanism, the pressure of the rebound air at the detector reaches a value at which the displacement device is set in motion to increase the distance between yarn package and traverse mechanism.

The drawback of this known winding device is that only a small part of the air streaming out is taken up by the detector as rebound air. Consequently, proper detection requires a relatively large air consumption.

Moreover, the amount of the detected, rebound portion of air flowing from the detector is a function of the circumferential speed of the yarn package. As the circumferential speed of the yarn package increases, a smaller portion rebounds and consequently, other conditions remaining unchanged, a small distance between yarn package and traverse mechanism will be obtained.

Another drawback of the known winding device is that a small change in the distance between yarn package and traverse mechanism will be translated into a large difference in the pressure of the detected, rebound air. This may give rise to an uneven control over the displacement device.

SUMMARY OF THE PRESENT INVENTION

The winding device according to the present invention avoids the above drawbacks, and is characterized by an element extending in the axial direction of and forming with the circumference of the yarn package a narrow air gap. A stream of air is directed in an essentially tangential direction with respect to the yarn package, producing an air gap between the element and the yarn package. The pneumatic detector has an air duct opening into or near the air gap to guide at least part of the tangential air stream produced by the rotation of the yarn package. The detector is equipped with a jet pipe connected to the source of compressed air to supply the main air stream and an intake pipe to take in at least a part of the main air stream. The jet and intake pipes are aligned in such a manner that the tangential air stream picked up in the air duct intersects the main air stream. The tangential air stream can be produced by a fan or other source of air flow which insures a forced air flow through the air gap.

According to a simpler version which appears to be very efficient, use is made of the tangential air stream produced by the rotation of the yarn package at the circumference thereof. The detector picks up the air entrained by the yarn package and guides the main air stream from the jet with it to the intake pipe. The main air stream is inversely proportional to the amount of tangential air stream in the air gap, i.e, the main stream is greater as tangential air stream is smaller.

The winding device of the invention has the advantage of lower air consumption and can be used over a wider yarn speed range without need to readjust the control settings of the displacement device. Further, the device reacts less drastically to a change in the air gap so that a more stable positioning results.

The element which forms a narrow air gap with the yarn package can be a flat or curved plate which is held by the displacement device at a short distance from the circumference of the yarn package. In case the winding device is provided with a traversing mechanism comprising a grooved roll and a thread guide driven by the latter, the element forming a narrow air gap with the yarn package can advantageously be a grooved roll.

In a preferred version of the device according to the invention, the air duct of the pneumatic detector extends over at least a considerable part of the axial dimension of the yarn package.

A further advantage of this version over the known device is that the tangential air stream is not affected by local unevenness of the yarn package, but depends only on the average gap width over the axial length of the yarn package.

A further variant of the device according to the invention is characterized in that the air duct is formed by an elongated tube, one end of which is located near the air gap, and in open connection with the environment, in that the jet and intake pipes are fastened to the tube at a location removed from said end, in such a manner that the main air stream is aimed perpendicular to the longitudinal direction of the duct, and in that the air duct forms an air buffer between the cited end and the jet and intake pipes. With this version, pressure fluctuations are averaged with time as a result of the buffer action of the air duct of the detector, resulting in more flexible control of the displacement device.

An eminently suitable version of the device according to the invention is characterized in that the displacement device comprises a logic control unit coupled with the pneumatic detector. When the pressure in the intake pipe rises over a first adjustable pressure limit value, the logic control unit causes the displacement device to move the traverse mechanism away from the yarn package. When the pressure in the intake pipe drops below a second adjustable limit pressure, which is lower than the first limit pressure, the logic control unit will stop the movement of the traverse mechanism away from the yarn package.

This version differentiates advantageously in the following respects from the known device according to U.S. Pat. No. 3,845,912. In the latter, a pneumatic amplifier is located between the detector and the displacement element of the traverse mechanism. The amplifier responds to a given first pressure level of the rebound air and feeds compressed air to the displacement element to increase the distance between the traverse mechanism and the yarn package. At a given second pressure level, which is lower than the first, the amplifier shuts off the supply of compressed air to the displacement element as a result of which the displacement of the traverse mechanism stops.

The difference between the first and second pressure produced by the hysteresis of the pneumatic amplifier is so great that the correction motion is maintained too long, causing the traverse mechanism to travel further away from the yarn package than necessary. To overcome this drawback, special devices are provided consisting of a relay valve located between the detector and the amplifier, and an air buffer between the output of the amplifier and the relay valve. When the pressure signal of the detector exceeds the response value (first pressure) of the amplifier, causing the latter to open the compressed air supply to the displacement element, compressed air will then also be supplied to the air buffer. The latter is filled after about one second and then shuts off the relay valve, which interrupts the signal of the detector to the pneumatic amplifier as well as the supply of compressed air to the air buffer and displacement element. This stops the displacement of the traverse mechanism, and the pressure in the air buffer drops again. Finally, the relay valve opens so that the pressure signal of the detector has again access to the amplifier. If, during this one second interval, the traverse mechanism is not removed far enough away from the yarn package, the just described process repeats itself. The traverse mechanism, during a second period of one second is then removed further away from the yarn package. This process is repeated until the traverse mechanism assumes the proper distance from the yarn package. The duration of the period (in this case 1 second) during which displacement takes place is, of course, selected so that the displacement taking place during this period is smaller than that which would take place in the situation without the above-mentioned special provisions. In this way, the hysteresis of the pneumatic amplifier is prevented from influencing the displacement of the traverse mechanism.

As soon as the pressure signal of the detector exceeds the response value of the amplifier, the traverse mechanism performs a correction step of specific magnitude which is smaller than the displacement which would occur if no special provisions were made.

A drawback of the known version is that during the correction step, the detector signal has no influence. There is no regulating circuit which during the correction step continuously compares the distance between traverse mechanism and yarn package to the desired distance. The known device carries out correction steps of fixed magnitude and determines after each step whether another one is required. In the device of the invention, however, the detector signal can continuously influence the displacement of the traverse mechanism. As soon as the pressure of the detector signal drops below the second limit value pressure, the movement of the traverse mechanism away from the yarn package is stopped.

Another advantage is that both the response value (=first limit pressure) and the second limit pressure are adjustable so that they both can be adjusted to an optimum value for the correction of the gap width.

When the pressure in the suction pipe drops below the second limit pressure, the direction of motion of the traverse mechanism should be reversible. It is, however, simpler to have a version of the device according to the invention whereby the logical control device checks the displacement of the traverse mechanism with respect to the yarn package when the pressure in the suction pipe drops below the second limit pressure.

It is pointed out that where mention is made of "removal" or "displacement" of the traverse mechanism this always refers to a motion of the traverse mechanism relative to the yarn package. This relative motion may be a translation of the traverse mechanism alone, but also of the package alone. In the former case, the traverse mechanism is coupled with the displacement device, in the latter case the yarn package.

The device according to the invention has preferably a further characteristic in that the logical control device comprises two pneumatic limit value switches connected to the intake pipe.

Since the aim of the invention is to have no contact with the yarn package during winding, conventional circumferential driving of the yarn package cannot be used to maintain a constant circumferential speed. It is then necessary to drive the yarn package via its shaft and to regulate the revolutions of the drive shaft so that during the growth of the yarn package its circumferential speed remains unchanged.

In case the yarn winding passes a speed-imposing unit, such as a godet, the speed regulation can be based on any measurement of the tension force in the yarn. In this case the rotation speed is so regulated that the tension in the yarn between the speed-imposing unit and the yarn package remains constant.

However, if a speed-imposing unit before winding is undesirable so that the yarn speed is only determined by the winding speed of the package, and if a further prerequisite is to control the winding speed without contact with the yarn, then besides a tensile force measurement the winding speed regulation can be based on a velocity measurement of the yarn. Problems arise, however, if the yarn is to travel free from contact with a velocity measuring unit.

This situation arises during high speed spinning of synthetic yarn. At spinning speeds of several thousand meters per minute it is desirable before winding that the yarn have as little contact as possible with any elements. The design of the winding unit with a traverse unit remaining at a distance from the yarn package is prompted by the desire to treat the yarn as gently as possible.

The present invention provides a solution for winding yarn at constant speed without contact before reaching the package with a speed-imposing or speed measuring unit. To this end, the winding device according to the invention is equipped with a drive unit, including a drive motor of adjustable rotation speed, to wind the yarn at constant speed on the yarn package, the drive unit is furthermore equipped with:

a. two detectors to emit electronic signals x(t) and y(t), respectively related to the motion of the yarn, which detectors are spaced near the yarn path at a given distance L from each other;

b. a correlation device to supply an electrical signal that agrees with the cross correlation $C_c$ of the signals emitted by the detectors for a given setting value $\tau$ of the lag time, expressed by $$\tau = \frac{L}{V_g}$$

wherein $V_g$ represents the desired yarn speed;

c. means to determine whether $C_c$ has reached its maximum; and d. means to correct the rotational speed of the drive motor until $C_c$ becomes maximum.

Cross correlation $C_c$ refers in a general sense, within the scope of this invention, to any suitable function reflecting the agreement between signal x(t) and y(t) or signals derived therefrom as a function of the lag time between the two.

For the detectors, use can be made, for example, of optical/electronic receivers which convert light reflected by the yarn into an electrical signal. Use is, however, preferably made of a design whereby the detectors are electrostatic detectors emitting electrical signals x(t) and y(t) derived from the electrostatic charge present on the yarn.

The use of electrostatic detectors for the contactless determination of the velocity $V_g$ of a yarn is described as such in British Patent specification 1,249,610. Use is made here of two measuring electrodes spaced at a certain distance L from each other which reach close to the yarn but do not come in contact with it. Electric voltages are induced in the electrodes as a result of the electrostatic charge present on the yarn. The trend thereof as a function of time, shows a high degree of agreement, taking into account the time lag of $$\tau = \frac{L}{V_g}$$

This is used to determine the yarn velocity from the relationship $V_g = L/\tau$.

It is also known (cf. Tijdschrift voor Chemie en Instrument, 1970, pp. 413–419) to determine the velocity of a sheet of material by determining the cross correlation maximum of two receiver signals located along the sheet. If this maximum occurs at a time lag $\tau$, the velocity V of the material sheet is then calculated from $$V = \frac{L}{\tau}$$

wherein L represents the distance measured between the two receivers along the material sheet.

The two above-discussed publications, however, are directed only to the determination of the velocity of a material sheet. Neither teach controlling the yarn speed. Using as cross correlation the function $$\Phi_{xy}(\tau) = \lim_{\tau \to \infty} \frac{1}{2\tau} \int_{-\tau}^{+\tau} \{x(t) - \bar{x}(t)\} - \{y(t-\tau) - \bar{y}(t)\}dt,$$

wherein $\overline{X}(t)$ and $\overline{y}(t)$ represent the averages of x(t) and y(t) respectively, it will then be necessary in order to determine the maximum of $\Phi_{xy}$ to calculate this function for different values of $\tau$. This is too time-consuming for instantaneous correction of the winding speed to the desired level in case of deviations in the yarn velocity. In this connection there is one preferred version of the device of the invention characterized in that the means to determine whether the cross correlation has reached maximum, include a differentiator to differentiate according to time one of the two detector signals so that a differentiated detector signal $\dot{y}(t)$ is obtained, and in that the signal x(t) and y(t) are fed to the correlation device.

The cross correlation assumes hereby the following form $$\Phi_{x\dot{y}}(\tau) = \lim_{\tau \to \infty} \frac{1}{2\tau} \int_{-\tau}^{+\tau} \{x(t) - \bar{x}(t)\} - \dot{y}(t-\tau)dt$$

The function $\Phi_{x\dot{y}}(\tau)=0$ for $\Phi_{xy}(\tau)=$maximum, so that the problem of the determination of the maximum value of $\Phi_{xy}(\tau)$ amounts to the simpler determination of the 0 passage of the function $\Phi_{x\dot{y}}(\tau)$.

A further simplification of the winding speed control can be achieved with a device characterized by:

a. polarity detectors, to which the signals x(t) and $\dot{y}(t)$ are supplied and which emit the output signals sign x(t) or sign y(t), which reflect the polarity of signals x(t) and $\dot{y}(t)$ based on a reference value;
b. a shift register, the input of which receives signal sign x(t);
c. a shift pulse generator connected to the shift register which transmits shift pulses of adjustable frequency $f_s$, so that the shift register supplies to its $n^{th}$ element an output signal sign $x(t-(n/f_s))$;
d. a multiplicator to multiply the output signal sign $x(t-(n/f_s))$ by the signal sign $\dot{y}(t)$; and
e. an integrator connected to the output of the multiplicator, and forming part of the correction means to correct the rpm of the drive motor.

Use is made hereby of the well-known principle of polarity correlation for the velocity determination of gases and liquids. This means that the cross correlation of signals x(t) and $\dot{y}(t)$ with amplitudes distributed according to a Gaussian curve, shows for the same values of $\tau$, zero passages and extremes as does the cross correlation of sign x(t) and sign $\dot{y}(t)$. The correlation can then be realized via simple digital means, whereby a shift register takes care of the time lag $\tau$. (See Messtechnik 7, 1971, pp. 152–157).

A first version of the latter device according to the invention utilizes a drive motor regulator which is provided with an input for the measured value of the yarn speed and an input for the desirable yarn speed value. The shift pulse generator is composed of a pulse generator with a pulse repeating frequency depending on a control voltage, and the integrator connected to the output of the multiplicator has its output connected to a control input of the pulse generator to supply the control voltage. The output of cited integrator is furthermore connected to the measured value input of the automatic regulator.

Another version of the device of the invention utilizes an automatic regulator for the drive motor rotational speed. The integrator connected to the output of the multiplicator forms part of the automatic regulator, and the shift pulse generator is formed by a pulse generator supplying shift pulses at a frequency of $f_s = n.V/L$ to the shift register. The preferred version according to the invention whereby no differentiation of the analog detector system is necessary, is characterized in that the correlation device comprises a. polarity detectors receiving signals x(t) and y(t) and supplying output signals sign x(t) and sign y(t) that indicate the polarity of signals x(t) and y(t) with respect to the reference value;
b. an N-bits shift register to the input of which signal x(t) is supplied;
c. a shift pulse generator connected to the shift register supplying shift pulses of adjustable frequencies $f_s$, so that the shift register transmits an output signal sign $x(t-(i/f_s))$ to its $i^{th}$ element;

d. a first multiplicator connected to the output of the $(n-2)^{th}$ element of the shift register and the output of the polarity detector for the signal y(t), for logical multiplication of the signals sign $$x(t - \frac{n-2}{f_s})$$

and y(t), whereby $n \leqq N$;

e. a second multiplicator connected to the output of the $n^{th}$ element of the shift register and to the output of the polarity detector for the signal y(t) for logical multiplication of signals sign $x(t-(n/f_S))$ and sign y(t);

f. a clock pulse generator;

g. an electronic differential counter connected to the clock generator which opens the subtraction input under control of the first multiplicator and the addition input under control of the second multiplicator to count backward or forward of the clock pulses; and h. a digital analog converter connected to the counter to convert the counter content into an analog signal that is transmitted to the shift pulse generator.

For the polarity detectors use is preferably made of a comparator which supplies output voltages at one of two logical levels "1" or "0", at one level if the input voltage of the comparator is above the reference value and at the other level if the input voltage is below the reference value.

As a multiplier, use can be made of a logical circuit with the function $\overline{X}.\overline{Y}+X.Y$ in which X and Y are the signals at the input of the multiplicator.

In a different version, the multiplicator formed by a logical circuit with the function $X\overline{Y}+\overline{X}Y$, wherein X and Y are the signals at the input of the multiplicator.

The invention will be explained in greater detail on the basis of the examples illustrated in drawings.

DETAILED DESCRIPTION OF THE DRAWINGS

Figure 1:
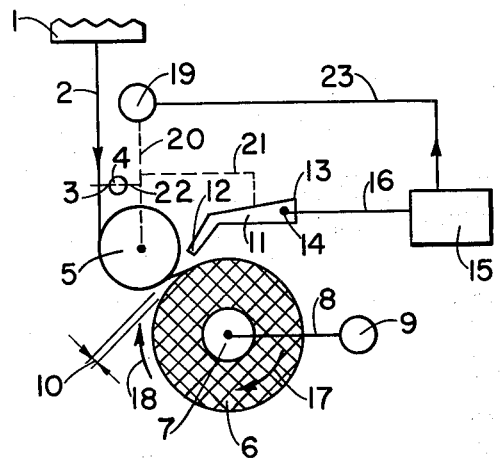
FIG. 1 is a schematic of a winding device according to the invention.

A bundle of filaments 2 from a melt spinning device are depicted schematically in FIG. 1. It must be pointed out that the invention is not only suitable for winding multifilament yarn but also monofilament yarn. Bundle 2, to be hereinafter referred to as yarn, travels to a mechanism. The term traverse mechanism refers to any mechanism which imparts to the yarn a traverse motion across its direction of travel in order to be able to wind it on a yarn tube. To this end, the traverse mechanism may assume various forms. For instance, the traverse mechanism may comprise a thread guide to which a reciprocal motion is imparted by a bar. The traverse mechanism may also comprise a thread guide, part of which is seated in the helical groove of a roll, which while rotating imparts a traverse motion to the thread guide. It is also conceivable that the traverse mechanism comprises next to the above-discussed combination of thread guide with related drive mechanism a grooved roll with drive mechanism, which grooved roll imparts to the yarn a traverse motion just prior to winding. With a device of this type, the yarn passes first the traversing thread guide and then the grooves in the grooved roll. By matching the translation of the thread guide to the rotation of the grooved roll, one may insure that the length of the yarn piece participating in the traverse movement remains as much as possible unchanged during the reciprocal motion. This counteracts the occurrence of tension peaks in the yarn during traversing. Winding devices with a traverse mechanism of the just described design are cited in e.g., Dutch Patent published Application No. 6 917 046 and U.S. Pat. No. 3,861,607; 3,945,581, and 3,792,819.

Assuming that in the version according to FIG. 1 the traverse mechanism is composed of a reciprocating thread guide 3, a traverse roll 4 provided with helical grooves actuating thread guide 3, a grooved roll 5 and a drive motor actuating the traverse and grooved roll (the latter is not shown in FIG. 1). At some distance from the grooved roll is a yarn package 6 wound on tube 7 located on a drive shaft 8. Drive shaft 8 is rotated by drive motor 9.

Yarn package 6 forms with the traverse mechanism, in this case with grooved roll 5, a narrow air gap 10 extending over the axial direction of the yarn package. A pneumatic detector consisting of an air duct 11 is located near the circumference of the yarn package, the left end 12 of which opens near air gap 10. At the other end 13 of air duct 11 two air connections are located on either side, one of which is shown in FIG. 1 and identified as 14. Each air connection is connected to a pneumatic control device 15, air connection 14 via line 16.

Figure 2:
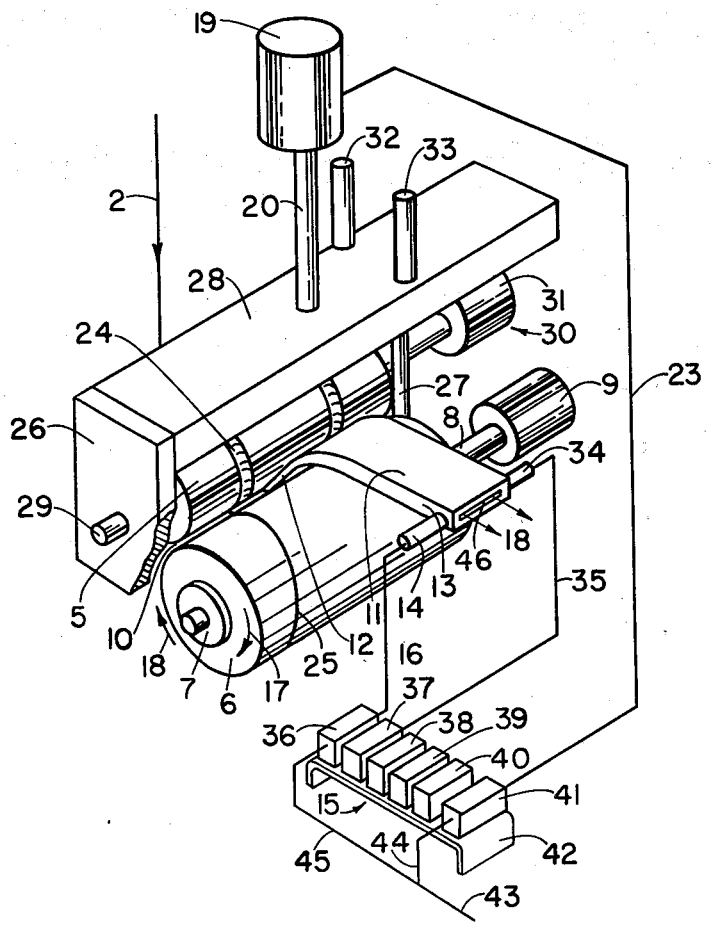
FIG. 2 is a detail of the winding device shown in FIG. 1.

As shown in FIG. 2, a main stream of air is supplied via one of the lines to air duct 11, flows through the air duct 11 in a direction across the longitudinal direction of the duct and is then returned via the other air line to the control device.

As a result of the rotation of the yarn package in the direction of rotation identified in FIG. 1 by arrow 17, a tangential air current is generated, see arrow 18. Depending on the size of air gap 10, a greater or smaller share of the tangential air stream 18 flows from the slit in air duct 11. As a result, the main stream of air is more or less interrupted, so that the pressure of the air returned to the control device is accordingly lower or higher. The latter pressure is therefore a criterion for the size of air gap 10, so that it can be used to control the size of air gap 10. To this end, pneumatic control device 15 is connected with a displacement device 19 which moves grooved roll 5 away from the yarn package as the latter increases in diameter. The required coupling between displacement device 19 and grooved roll 5 is schematically shown in FIG. 1 by broken line 20. Pneumatic detector 11 and traverse roll 4 with thread guide 3 are also coupled with displacement device 19, as indicated by broken line 21 or 22. As soon as displacement device 19 is actuated, grooved roll 5, pneumatic detector 11 and traverse roll 4 with thread guide 3 are set in motion as a unit. Controlling of the displacement device 19 by control device 15 is illustrated by line 23. This control can be accomplished by pneumatic, hydraulic or electrical means.

Figure 3:
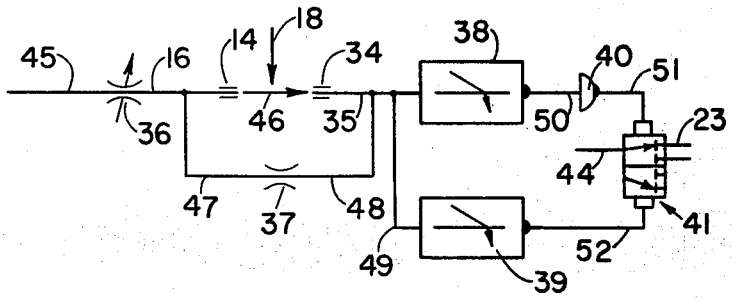
FIG. 3 is a principle design of the pneumatic control used for the winding device of the invention.

On hand of FIGS. 2 and 3, we shall now discuss in greater detail the positioning of traverse mechanism 3-4-5 and of pneumatic detector 11 shown schematically in FIG. 1. Corresponding parts are identified with the same numbers as in FIG. 1.

While traveling to yarn package 6, yarn 2 travels on thread guide 3 not shown in FIG. 2 and subsequently helical groove 24 at the circumference of the grooved roll. In FIG. 2 25 identifies the last placed yarn turn. The shaft ends of grooved roll 5 are positioned in bearing plates 26, 27 of a bridge element 28. The visible left shaft tip is identified as 29. The grooved roll is driven by an electromotor 30, the stator 31 of which is mounted on bridge 28. Bridge 28 also supports traverse roll 4 with thread guide 3, not shown in FIG. 2. Bridge 28 may travel upward under the influence of pneumatic cylinder 19 whose piston is coupled with bridge 28 via piston rod 20. The bridge is guided thereby by guide rods 32 and 33.

The left end 12 of air duct 11 opens near air gap 10 between yarn package 6 and grooved roll 5, which duct functions as pneumatic detector. End 12 extends over a considerable part of the length of yarn package 6 in order to level out as much as possible the influence of local deviations in the width of the air gap. A jet 14 and an intake 34 are mounted at the right end 13 of air duct 11. The former two are connected by means of flexible hoses 16 and 35, respectively, to pneumatic control device 15 consisting of 6 elements 36 to 41, positioned on a chassis 42. The control device is connected via compressed air lines 43, 44 to a source of compressed air (not shown) which can be connected to pneumatic cylinder 19 via structural element 41 and air line 23. Another compressed air line 45 supplies compressed air to structural element 36. Tangential air stream 18 taken up by air duct 11 meets at end 13 main air stream 46 between jet 14 and intake 34. FIG. 3 shows schematically how tangential air stream 18 controls the position of bridge 28 and of the traverse mechanism connected to it.

Compressed air flows through air line 45 via a restriction 36 and line 16 to jet 14 which is positioned on pneumatic detector 11. The air streaming out of jet 14 flows in the direction of intake 34 which is likewise positioned on detector 11 opposite jet 14. The inlet of jet 14 is connected via line 47, restriction 37, line 48 and line 35 to the outlet of intake 34. Line 35 is furthermore connected to a first pneumatic limit switch 38, and via line 49 to a second pneumatic limit switch 39. Limit switch 38 is connected by line 50, reversing element 40 and line 51 to control valve 41. Limit switch 39 is connected by line 52, to control valve 41. Although this is not shown in FIG. 3, limit switches 38, 39 and reversing element 40 are connected to a source of compressed air.

Assuming that the yarn package 6 has so increased that air gap 10 is at the minimum value of for example 1 mm, the tangential air stream 18 will also be at minimum force. Main air stream 46 between jet and intake 14 and 34, respectively, will then be disturbed so slightly that the pressure of air in intake 34 is at maximum. This maximum pressure $P_1$ is given as "1". At the output of limit switch 38, in line 50, the air pressure is now at minimum expressed by "0". Reversing element 40 insures that the pressure in line 51 rises again to the maximum value of "1". As a result, control valve 41 assumes the position shown in FIG. 3, where compressed air line 44 is connected with line 23. Compressed air now flows through the latter line to pneumatic cylinder 19 which via piston rod 20 moves bridge element 28 with the traverse mechanism upwards so that air gap 10 is enlarged.

While the air pressure in line 35, and consequently also in line 49, had a value of "1", the air pressure in line 52, after second limit switch 39, was "0". As a result of the displacement of the traverse mechanism, the width of air gap 10 has increased, increasing the force of tangential air stream 18. The pressure in intake 34 and consequently also the pressure in lines 35 and 49 drops as a result and reaches ultimately a limit value $P_2$ ($P_2 < P_1$), corresponding to "0". The second limit switch 39 now raises the pressure in line 52 to a value of "1". Since the pressure in line 51 has meanwhile dropped to a value of "0", control valve 41, under the influence of the pressure in line 52, assumes a position whereby the connection between compressed air line 51 and line 23 is interrupted. The movement of the traverse mechanism in a direction away from the yarn package is now stopped. It is also conceivable to control air gap 10 in a manner whereby next to a correction movement of the traverse mechanism in a direction away from the yarn package, a correction movement towards the yarn package is possible.

As has already been outlined, limit switches 38 and 39 produce a logical reversal of their input signals. At input signal "1" they thus supply an output signal of "0" and vice versa. In principle, it should therefore be possible to substitute the combination of limit switch 38 with reversal element 40 by a limit switch which does not bring about this logical reversal. It has, however, been found that with said combination of structural elements, positioning is more secure. Elements 38, 39 are pneumatic limit switches manufactured by Dreloba.

The limit value ($P_1$ or $P_2$) is adjustable.

Locating the main air stream at a spot at some distance from air inlet 12 provides the advantage that fluctuations in the tangential air stream are leveled off by the buffer effect of the air duct. It should be pointed out here that the reference to a jet or an intake pipe is in no way limiting. It implies any provision supplying a main air stream across the tangential air stream and being influenced by the latter to a sufficient degree.

So far as the tangential air stream is concerned, it is not absolutely necessary to use for the latter the air entrained by the rotation of the yarn package. Instead, it should also be possible via other means to obtain a tangential air stream in the air gap. For example, a fan could be used to maintain a forced air flow in the air gap. With the above-described control system, the width of the air gap was controlled within only a few millimeters at yarn speeds of 3,000 to 5,000 meters/minute.

Figure 4:
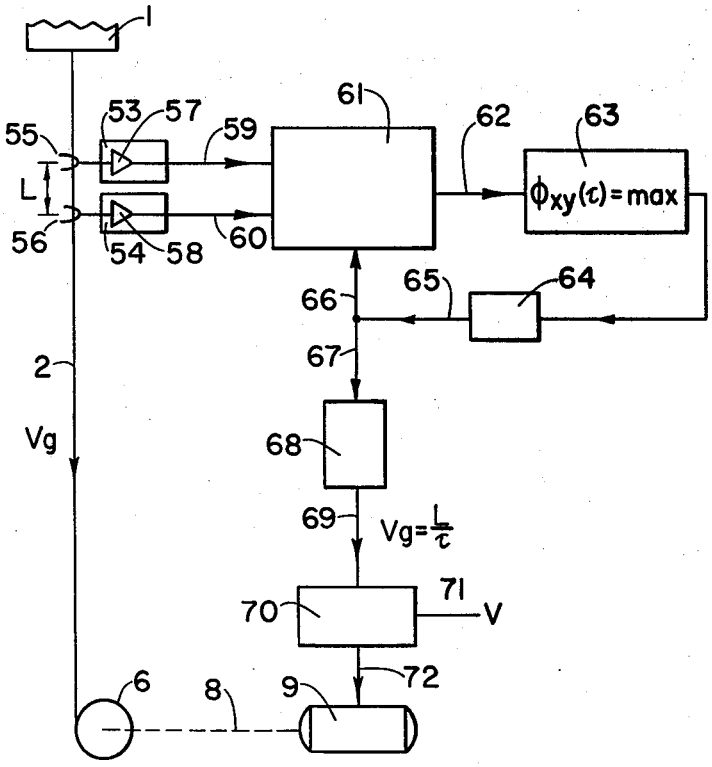
FIG. 4 is a schematic of the rpm regulation for the winding device of the invention.

The system for the rpm regulation of drive motor 9 will be discussed with reference to FIGS. 4 to 7. In FIG. 4, a number of filaments combined to a yarn 2 are spun from a melt spinning device identified here too by 1. Yarn 2 is wound—without passage on a speed-imposing element e.g. a godet—onto a package 6 which is rotated by motor 9.

Near the path of yarn 2 are spaced two electrostatic detectors 53, 54 at a distance L from each other. Each of the detectors consists of an electrode 55 and 56, respectively, and a signal amplifier 57 and 58. The detectors are not in contact with the yarn.

As a result of the electrostatic charge present on yarn 2 electrical alternating voltages are induced in electrodes 55, 56, and are amplified by amplifier 57, 58. These amplified voltages x(t) and y(t) are transmitted via connections 59 and 60 to a correlation unit 61. Correlation unit 61 derives a signal therefrom which at least by approximation provides correlation function:

$$\Phi_{xy}(\tau) = \lim_{\tau \to \infty} \frac{1}{2\tau} \int_{-\tau}^{+\tau} x(t-\tau) - y(t)$$

This signal is fed via line 62 to extreme-seeking circuit 63 which serves to find the value $\tau$ for which the function $\Phi_{xy}(\tau)$ has a maximum. Systems for the determination of the maximum value of a function are known as such. In the case under discussion circuit 63 resets via correction elements 64 and connections 65 and 66 the setting of lag time $\tau$ in correlation unit 61. The signal representing the adjusted lag time $\tau$ is also fed via line 67 to calculation unit 68. The latter transmits to line 69 a signal corresponding to the quotient $$V_g = \frac{L}{\tau}$$

wherein L represents the distance between detectors 53 and 54, the adjusted lag time, $V_g$ the calculated yarn speed.

The signal of the calculation unit 68 is transmitted to an automatic regulator 70, which is used to adjust the rpm of winding motor 9 so that the winding speed $V_g$ of the yarn is maintained at a desired value V. The latter is set on automatic regulator 70, as shown schematically by connection 71. The connection between regulator 70 and winding motor 9 is identified by 72, the drive shaft for the yarn package by broken line 8.

Figure 5:
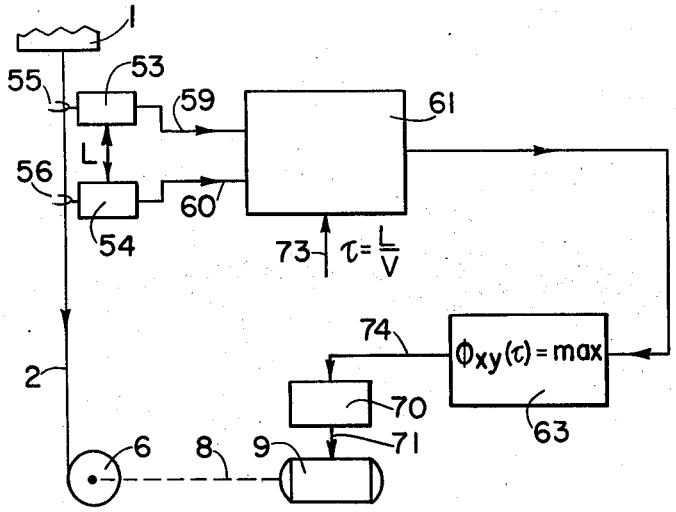
FIG. 5 shows a variant of the rpm regulation according to FIG. 4.

Another version of the regulating system is shown in FIG. 5. In correlation device 61 a fixed value for the time lag $\tau$ is adjusted which corresponds to the desired yarn speed V according to the relationship $$\tau = \frac{L}{V}$$

This adjustment possibility is identified by arrow 73. The extreme-seeking circuit 63 is now connected via connection 74 to automatic regulator 70. Regulator 70 insures that the drive motor is brought to an rpm at which the correlation function $\Phi_{xy}(\tau)$ reaches its maximum value.

There is no question of determining the momentary yarn speed $V_g$ and of comparing it with the desired value V as in the system according to FIG. 4. The entire version according to FIG. 5 forms now as it were an extreme-seeking system aimed at maximization of the correlation function $\Phi_{xy}(\tau)$ by variation of the rpm of drive motor 9.

A feasible design, based on the principle of the rpm regulation shown in FIG. 4 will now be discussed in more detail with reference to FIG. 6.

The signals of electrostatic detectors 53, 54 are again transmitted to correlation unit 61, but signal y(t) of detector 54 is first differentiated by RC circuit 75–76 to $\dot{y}(t)$.

The correlation unit 61 has two polarity detectors in the form of comparators 77,78 to which signals x(t) and $\dot{y}(t)$ are transmitted. The comparators are adjusted to a reference voltage 0, at which they transmit a block voltage which is positive ('1') if the input signals are positive, and which is ('0') if the input signals are negative. The output signals of the comparators thus indicate the polarity of their respective input signals—they are identified as sign x(t) and sign $\dot{y}(t)$.

It should be pointed out that the output signal of the comparators need not necessarily vary between a positive value and 0, as would be the case if the applied logic were of the TTL type. It is also possible to devise the circuit so that this signal varies between a positive and a negative value. For instance, the output signal of the comparators may be positive if the input signal is positive, and negative if the input signal is negative. It is furthermore conceivable to adjust the comparators to another reference voltage than 0. This would be based on the fact that the input signals of the two comparators, taking into account a lag time determined by the mutual spacing of detectors 53 and 54, exhibit considerable agreement in form as well as in amplitude.

In the correlation unit the output signal of comparators 77 and 78 are transmitted via lines 79 or 80 to shift register 81 and multiplicator 82. Shift register 81 serves to delay for a certain time $\tau$ the transmission of signal sign x(t) to multiplicator 82. To this end, the elements of the shift register are connected via the schematically shown connection 83 to a shift pulse generator 84. The latter is of the type which converts an electric voltage into a pulse train with a pulse repeating frequency proportional to the input voltage.

Assuming shift register 81 consists of n elements and furthermore that the repeating frequency of the shift pulses supplied by generator 84 is $f_s$, the output signal of comparator 77 will after a time $\tau = n/f_s$ appear at the output of shift register 81. The output signal sign $x(t-(n/f_s))$ is transmitted via line 85 to multiplicator 82. Multiplicator 82 is a logical circuit emitting an output signal Z to connection 86 which according to the following table is a function of input signals X, Y:

| X | Y | Z |
|---|---|---|
| 0 | 0 | 1 |
| 0 | 1 | 0 |
| 1 | 0 | 0 |
| 1 | 1 | 1 |

Multiplicator 82 will thus only supply an output signal '1' if the polarity of both input signals on lines 85, 80 are identical. The logical circuit should then have the function $\overline{X}.\overline{Y}+X.Y$ wherein X and Y represents the signals at the inputs of the multiplicator. It follows from the above that according as the time lag $n/f_s$ of shift register 81 is closer to the value $L/V_g$, the output of multiplicator 82 will have a value of '1' over a longer period of time. To have the value $n/f_s$ get as close as possible to value $L/V_g$, shift pulse generator 84 must emit pulses, the frequency of which is as much as possible equal to:

$$\frac{V_g \cdot n}{L}$$

To this end, the input of shift pulse generator 84 is connected via lines 88 and 87, integrator 89 and line 86 with the output of multiplicator 82. As long as the pulses at the input of multiplicator 82 are not simultaneous, multiplicator 82 will emit an output signal code '0'. This is recorded by integrator 89 as deviation, which appears integrated at output 87. The frequency of shift pulse generator 84 is modified in such a manner thereby that the value of $n/f_s$ comes closer to the value of $L/V_g$. Ultimately, a situation is reached wherein integrator 89 transmits a voltage U to shift pulse generator whereby $$\frac{n}{f_s} = \frac{L}{V_g}$$

Since voltage U is proportional to $f_s$, U is also a criterion for the yarn speed $V_g$. With $U=c \cdot f_s$, it follows that $$V_g = \frac{L \cdot U}{C \cdot n}$$

To bring the rpm of drive motor 9 to a value corresponding to the desired yarn speed V, output voltage U is transmitted via lines 87 and 69 to an automatic regulator 70. Of the latter the set point is adjusted to the desired yarn speed V. This adjustment possibility is illustrated schematically in FIG. 6 by arrow 71.

Regulator 70, which is of the PI-type is connected via connection 72 with an inverter 90 to actuate drive motor 9, being a synchronous 3-phase motor. Motor 9 is supplied via supply element 91 by inverter 90. The inverter supplies 3-phase current the frequency of which is a function of the magnitude of the DC current supplied by regulator 70. The rpm of drive motor 9 can thus be regulated via the input voltage on connection 72. The inverter is of a known type, consisting of a transformer which transforms a DC current into a 3-phase signal of specific frequency and a power amplifier.

As long as the yarn speed $V_g$, reflected by voltage U of integrator 89 is identical to the desired value V, the input voltage of the inverter 90 will remain constant and likewise the 3-phase current frequency and the rpm of drive motor 9. However, as soon as $V_g$ and V deviate, PI-regulator 70 intervenes to correct by modifying the input voltage of the inverter so that the yarn speed $V_g$ is brought back to the desired value. In this manner the yarn speed in the spinning zone can be maintained at the desired value V without having the yarn—before winding it on a yarn package—travel on a godet imposing to it a velocity V. To reduce the tension in the yarn wound on package 6, grooved roll 5 can be a so-called overfeed roll. This implies that the circumferential speed of grooved roll 5 is greater than the yarn speed, as a result of which the yarn tension is lower after than before the grooved roll. A tension reduction of this type is of course only possible if the overfeed roll travels clear of the yarn package, and thus cannot be obtained with a roll in contact with the yarn package. The same applies mutatis mutandis in case the winding tension is too low and consequently needs to be raised. This can be done by means of a lagging roll, i.e., a roll whose circumferential speed is lower than the speed of the supply yarn. Rut, both with an overfeed roll and an underfeed roll, an angle of contact of 240° or more is preferable. Another variant based on the principle of rpm regulation illustrated in FIG. 5 is shown in FIG. 7. This version is different from that shown in FIG. 6 to the extent that the shift pulse generator does now transmit shift pulses of a fixed frequency to shift register 81. This frequency is equal to $f_s=n \cdot V/L$ wherein n represents again the number of elements of shift register 81, L the mutual spacing between electrostatic detectors 53, 54, and V the desired yarn speed.

The time required by the yarn to travel the distance between electrostatic detectors 54 and 54 is $L/V_g$. The time required by signal sign x(t) to pass n elements of the shift register is $n/f_s=L/V$. As long as the two times are different, the multiplicator 82 records in the same manner as in the version shown in FIG. 6 that signals sign $x(t=(n/f_s))$ and sign y(t) do not coincide. In deviation from the version according to FIG. 6, the resulting 'error signal' of multiplicator 82 is now transmitted directly via connection 86 to PI-regulator 70. Regulator 70 transforms the frequency of the 3-phase current supplied by inverter 90 until the error signal of multiplicator 82 is eliminated. At that instant the times $L/V_g$ and $n/f_s$ are identical and since $n/f_s=L/V$ the yarn speed $V_g$ has thus reached the desired value V. In the version according to FIG. 7, the desired value is the time available to the yarn to cover the distance L between the two eletrostatic detectors 53 and 54. This desired value is set by setting the frequency of shift pulse generator 84 to $f_s=n \cdot V/L$.

Figure 6:
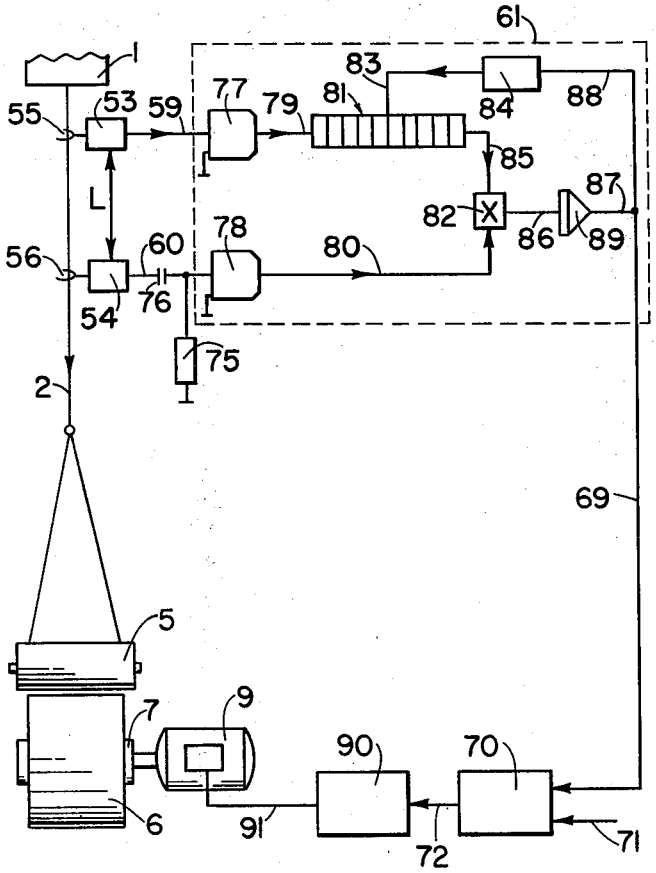
FIGS. 6 and 7 show a digital version of the rpm regulation according to FIG. 4 or 5.
Figure 7:
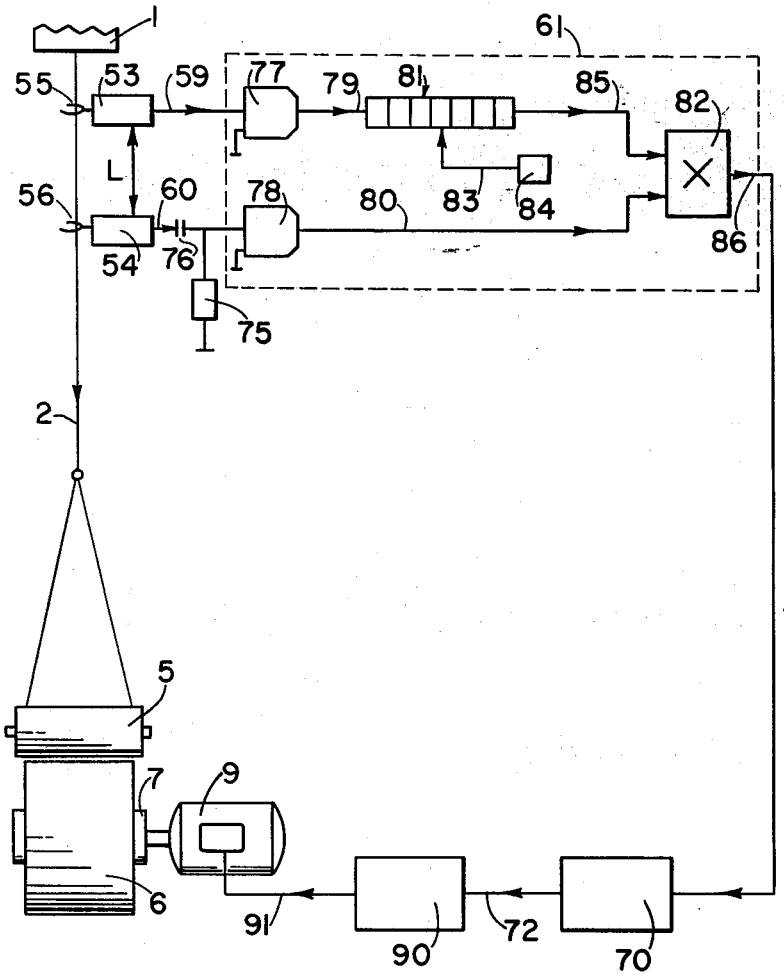

For multiplicator 82, both in the version of FIG. 6 and FIG. 7, use can be made of a logical circuit which instead of the function $$Z=\overline{X} \cdot \overline{Y}+X \cdot Y$$

represents its inverse $$Z=X \cdot \overline{Y}+\overline{X} \cdot Y$$

known as EXCLUSIVE OR:

| X | Y | Z |
|---|---|---|
| 0 | 0 | 0 |
| 0 | 1 | 1 |
| 1 | 0 | 1 |
| 1 | 1 | 0 |

A rpm regulation using a multiplicator working as EXCLUSIVE OR differs insofar from the systems described on hand of FIGS. 6 and 7 in that now Z='1' instead of Z='0' is used as error signal.

Figure 8:
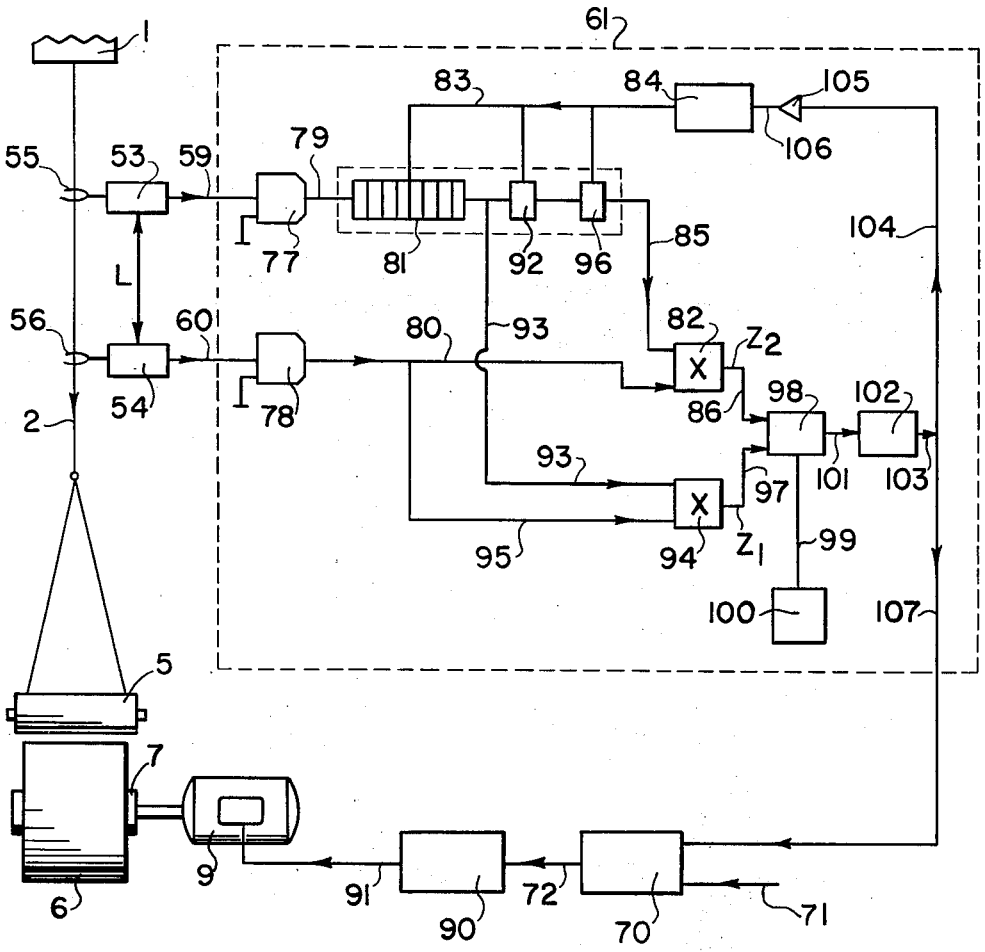
FIG. 8 illustrates a variant of the versions according to FIGS. 6 and 7.

Another variant of the rpm regulating system is shown in FIG. 8. It differs from the above-discussed systems to the extent that signal y(t) emitted by detector 54 is not differentiated. On n-bits shift register 81 the input of element 92 is connected via connection 93 to a first multiplicator 94. The other input of multiplicator 94 is connected via connections 95 and 80 to the output of comparator 78. As in the version according to FIGS. 6 and 7, the last shift register element 96 and comparator 78 are connected to multiplicator 82.

The outputs of multiplicators 82, 94 are connected via connections 86 and 97 respectively, to an electronic counter 98 to which pulses are transmitted via connection 99, which pulses are produced by a clock pulse generator 100 of high frequency constancy. Counter 98 transmits its signals via line 101 to a digital analog converter 102, which transmits its analog output signal via lines 103, 104 to amplifier 105. Amplifier 105 transmits the amplified analog signals via line 106 to shift pulse generator 84. The latter transmits shift pulses via connection 83 to shift register 81.

The digital-analog converter 102 is furthermore connected via connection 107 to automatic regulator 70.

The device according to FIG. 8 operates as follows: Assuming that the correlation unit 61 is set for a yarn speed $V_g$. The digital-analog converter 102 will then transmit to automatic regulator 70 a signal corresponding to the speed $V_g$. If it is identical to the desired value V set by means of connection 71, the rpm of drive motor 9 will stay at the input value.

The time required by the yarn to cover the distance L between detectors 53 and 54 will then be, as outlined below, $n-1/f_s$. The lag produced by the first $n-1$ elements of the shift register will thus be $L/V_g$. The time lag of the first $n-2$ elements of the shift register is $(n-2)/f_s$, that for all n elements $n/f_s$. The signal on connection 93 will thus be sign $$x\left(t-\frac{n-2}{f_s}\right),$$

that on connections 85 sign $x(t-(n)/f_s)$. Between elements 92 and 96 the signal is sign $$x\left(t-\frac{n-1}{f_s}\right).$$

The latter signal coincides with the signal sign $$y\left(t-\frac{L}{V_g}\right),$$

since $(n-1)/f_2=L/V_g$ and $y(t)=x(t-(L)/V_g)$ is assumed.

Figure 9:
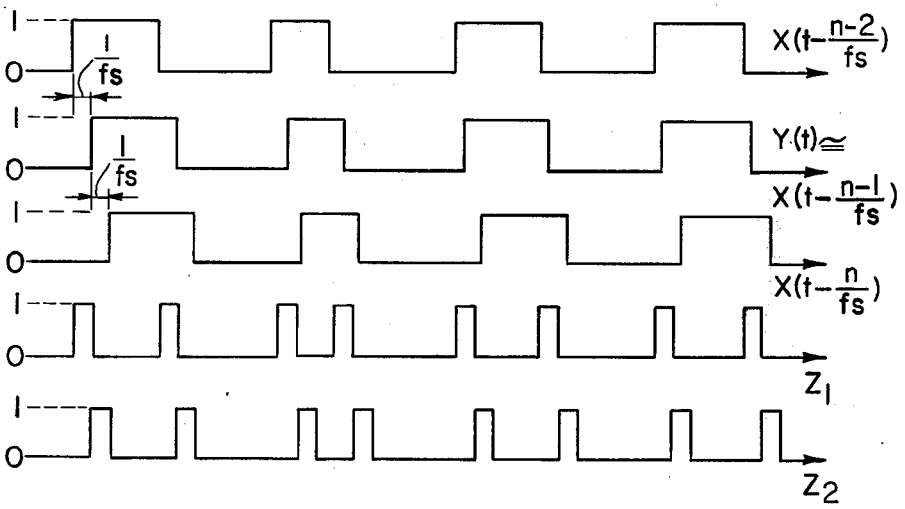
FIG. 9 illustrates the signals obtained with the version according to FIG. 8.

The signal on connection 93 is thus ahead of signal sign $$x\left(t-\frac{n-1}{f_s}\right)$$

by as much as the signal lags on connection 95 (see FIG. 9). Multiplicators 94 and 82, both of which are formed by an EXCLUSIVE OR circuit, now emit output signals which are identified as $Z_1$ and $Z_2$, respectively, in FIG. 9. Counter 98 operates to the effect that pulses $Z_2$ on connection 86 increase the counter content, whereas pulses $Z_1$ on connection 97 lower the counter content.

In the situation reflected in FIG. 9 whereby each pulse $Z_1$ is followed by a pulse $Z_2$ of equal duration, the content of counter 98 remains unchanged. The number of clock pulses of clock pulse generator 100 which raises the counter reading during pulse $Z_1$ is identical to the number of clock pulses lowering the counter content during the succeeding pulse $Z_2$. The content of counter 98 is converted by digital-analog converter 102 into a proportional analog signal, which after amplification in amplifier 105 sets the frequency $f_s$ of the shift pulse generator 84 to a value corresponding to the counter content.

Due to the diameter increase of the yarn package, the circumferential speed of the package and also the yarn speed increase gradually. The time lag between the signals $$x\left(t-\frac{n-2}{f_s}\right)$$

and y(t) addressed to the multiplicator decreases, while that between the input signals $x(t-(n)/f_s)$ and y(t) of multiplicator 82 increases. The result is that the width of pulses $Z_1$ becomes more narrow, while pulses $Z_2$, on the other hand, become wider. In this case counter 98 receives more clock pulses per time unit which increase the counter content than pulses which lower it.

Consequently, the counter content does increase, and the speed signal on connection 107 does also increase. Automatic regulator 70 reacts to this deviation by lowering the frequency of inverter 90, which brings the yarn speed back to the desired value. The advantage of the version according to FIG. 8 is that no analog differentiator is required, whereas a clock pulse generator 100 of accurately determined frequency will provide a high measuring and regulating precision. With a third multiplicator, the inputs of which are connected to the output of the $(n-1)^{th}$ shift register element 92 and line 80, a visual and/or acoustic signal can be triggered when $L/V_g=(n-1)/f_s$. In this case, the output signal of the third multiplicator will almost permanently assume a level "0" or "1", depending on whether it represents the logical function $$x\cdot\overline{Y}=\overline{X}\cdot Y \text{ or } \overline{X\cdot y}+X\cdot Y.$$

Although the invention referred to above relates to the winding of one yarn package, it is not limited to said application. The invention can just as well be used to wind several yarn packages. In this case, a correlation device can be used jointly for several winding points, which correlation device will be successively connected to the yarn speed detectors of each winding point.

What is claimed is:

1. An apparatus for winding a yarn into a yarn package on a tube, which apparatus is provided with a traverse device that runs clear of the yarn package and imparts traverse motion to the yarn in axial direction of the tube, and means positioned near the circumferential surface of the yarn package for pneumatically detecting the distance between the circumferential surface of the yarn package and the traverse device, said detector means comprising a male nozzle connected to a source of compressed air for delivering a main stream and a female nozzle for receiving at least part of the main stream, and a displacement means coupled to said pneumatic detector means and controlled thereby to displace the traverse device as a function of the air pressure in the female nozzle relative to the yarn package as it grows in size, the improvement comprising: element means extending in axial direction of the yarn package which in conjunction with the circumferential surface of the yarn package forms the boundary of a narrow air slit, means for producing an air stream through the air slit tangentially to the yarn package, air channel means in the pneumatic detector means ending in or near the air slit for receiving at least part of the tangential air stream, said male nozzle and female nozzle being positioned for the tangential air stream to cut the main air stream.

2. The apparatus of claim 1 wherein the traverse device comprises a grooved roll and a thread guide driven by said grooved roll.

3. The apparatus of claim 1 or 2, wherein the pneumatic detector means extends over a considerable part of the axial dimension of the yarn package.

4. The apparatus of claim 3 wherein the air channel means comprises an elongated tube, one end of which is positioned near the air slit and open to the surrounding air; and wherein said male nozzle and female nozzle are attached to said tube away from the end, said male nozzle directing the main air stream transverse to the longitudinal direction of the channel.

5. The apparatus of claim 1 wherein said displacement means comprises a logic control means cooperating with the pneumatic detection means for displacing the traverse device relative to the yarn package upon pressure in the female nozzle exceeding a first adjustable threshold pressure and stopping displacement upon pressure in the female nozzle dropping below a second adjustable threshold pressure lower than the first threshold pressure.

6. The apparatus of claim 5 wherein said logic control means include a pneumatic pressure switch for each of said first and second threshold pressures, said pressure switches being attached to the female nozzle.

7. The apparatus of claim 1 further comprising variable drive motor means for winding the yarn into a package at a constant speed, said drive means comprising:

(a) two detector means spaced a given distance L apart and giving off electric signals x(t) and y(t), respectively, which are associated with the movement of the yarn;

(b) correlator means for supplying an electric signal corresponding to cross-correlation of the signals given off by the detector means for a given set value $\tau$ of the delay time defined by $$\tau = \frac{L}{V_g}$$

where $V_g$ represents the desired yarn speed;

(c) means for determining whether the cross-correlation has reached its maximum; and (d) means coupled to said cross-correlation determining means for correcting the speed of the drive motor means until the cross-correlation has reached its maximum.

8. The apparatus of claim 7 wherein the electric signals x(t) and y(t) generated by the two detector means are a function of the electrostatic charge present on the yarn at the respective detector sites.

9. The apparatus of claim 7 or 8 wherein the cross-correlation determining means comprises means for differentiating with respect to time the y(t) function signal and feeding the so differentiated $\dot{y}(t)$ signal and the x(t) function signal to the correlator means.

10. The apparatus of claim 9 wherein said means for correcting the speed of the drive motor include (a) means for receiving, respectively, the signals x(t) and $\dot{y}(t)$ and converting the signals to sign x(t) and sign $\dot{y}(t)$ to indicate the polarities of x(t) and $\dot{y}(t)$ with respect to a given reference value;

(b) shift register means for receiving the signal sign x(t);

(c) shift pulse generator means connected to the shift register means for feeding shift pulses of adjustable frequency $f_s$ to the shift register means wherein the $n^{th}$ element of shift register means supplies an output signal sign $x(t-(n)/f_s)$;

(d) means for logic multiplication of the output signal sign $x(t-(n)/f_s)$ from the shift pulse generator by the signal sign $\dot{y}(t)$ from the converting means;

(e) automatic speed regulating controller means having an input for measured value of yarn speed and an input for a desired value of yarn speed; and (f) integrator means for receiving the output signal from the logic multiplication means; the output of said integrator means going to a control input of the shift pulse generator means and to input of the measured value of the automatic controller.

11. The apparatus of claim 7 or 8 wherein the correlator means comprises:

(a) polarity detector means for converting the signals x(t) and y(t) to sign x(t) and sign y(t), respectively, and indicating the polarity of the input signals relative to a given reference value;

(b) an N-bits shift register means for receiving the signal x(t);

(c) a shift pulse generator means connected to the shift register for feeding shift pulses of adjustable frequency $f_s$ to the shift register means so that at its $i^{th}$ element the shift register supplies an output signal of sign $x(t-(i)/f_s)$;

(d) a first multiplier means connected to the output of the $(n-2)^{th}$ element of the shift register means and to the output of the signal x(t) for the logic multiplication of the signals sign $$x(t - \frac{n-2}{f_s})$$

and y(t), where $n \leqq N$;

(e) a second multiplier means connected to the output of the $n^{th}$ element of the shift register means and to the output of the polarity detector means for the signal y(t) for logic multiplication of the signals sign $(t-(n)/f_s)$ and sign y(t);

(f) clock pulse generation means;

(g) electronic differential adding means connected to the clock pulse generation means, the output from the first multiplier means fed to a subtracting input of the adding means and the output from the second multiplier fed to the adding input of the adding means for respectively counting backward and forward clock in impluses applied; and (h) a digital-to-analog convertor means for converting the output of the differential adding means to an analog signal for the shift pulse generator means.

12. The apparatus according to claim 10 wherein the multiplier means comprises logic circuitry having the function $\overline{X}\,\overline{Y}+X\,Y$, where X and Y are the signals to the input of the multiplier means.

13. The apparatus according to claim 10 wherein the multiplier means comprises logic circuitry having the function $X\cdot\overline{Y}+\overline{X}\cdot Y$, where X and Y are the signals to the input of the multiplier means.

14. An apparatus for winding yarn into a yarn package on a tube, which apparatus is provided with a device comprising a drive motor having a variable speed for winding the yarn into a yarn package at a constant speed, characterized in that the device comprises:

(a) two detectors interspaced at a given distance L apart adjacent the yarn path, said detectors generating electrical signals x(t) and y(t), respectively, relative to the movement of the yarn;

(b) correlator means for receiving the signals x(t) and y(t) and supplying an electric signal corresponding to the cross-correlation of the detector signals for a given set value $\tau$ of the delay time defined by $$\tau = \frac{L}{V}$$

where V represents the desired yarn speed;

(c) means for determining whether the cross-correlation has reached its maximum; and (d) correcting means coupled to said correlator means to correct the speed of the drive motor until the cross-correlation has reached its maximum.

15. The apparatus of claim 14 wherein the detectors comprise electrostatic detectors.

16. The apparatus of claims 14 or 15 wherein the means for determining cross-correlation comprises a time differentiating means for the signal y(t) and means for sending signals x(t) and $\dot{y}(t)$ to the correlator means.

17. The apparatus of claim 16 wherein the correlator means comprises:

(a) means for converting the signals x(t) and $\dot{y}(t)$ to sign x(t) and sign $\dot{y}(t)$, respectively, to indicate the polarities of x(t) and $\dot{y}(t)$ with respect to given reference values;

(b) shift register means receiving the signal sign x(t);

(c) shift pulse generator means connected to the shift register for feeding shift pulses of adjustable frequency $f_s$ to the shift register means so that at it $n^{th}$ element the shift register means supplies an output signal sign $x(t-(n)/f)$;

(d) multiplier means for logic multiplication of the output signal sign $x(t-(n)/f_s)$ from the shift register means by the signal sign $\dot{y}(t)$; and (e) integrator means connected to the output of the multiplier means, forming part of the correcting means for adjusting the speed of the drive motor.

18. The apparatus of claim 14 or 15 wherein the correlator means comprises:

(a) polarity detector means for converting the signals x(t) and y(t) to sign x(t) and sign y(t), respectively, and indicate the polarity of the input signals relative to a given reference value;

(b) an N-bits shift register means for receiving the signal x(t);

(c) a shift pulse generator means connected to the shift register for feeding shift pulses of adjustable frequency $f_s$ to the shift register means so that at its $i^{th}$ element the shift register supplies an output signal of sign $x(t-(i)/f_s)$;

(d) a first multiplier means connected to the output of the $(n-2)^{th}$ element of the shift register means and to the output of the signal x(t) for the logic multiplication of the signals sign $$x(t - \frac{n-2}{f_s})$$

and sign y(t), where $n \leqq N$;

(e) a second multiplier means connected to the output of the nth element of the shift register means and to the output of the polarity detector means for the signal y(t) for logic multiplication of the signals sign $(t-(n)/f_s)$ and signs y(t);

(f) clock pulse generation means;

(g) electronic differential adding means connected to the clock pulse generation means, the output from the first multiplier means fed to a subtracting input of the adding means and the output from the second multiplier fed to the adding input of the adding means for respectively counting backward and forward the clock pulses applied; and (h) a digital-to-analog convertor means for converting the output of the differential adding means to an analog signal for the shift pulse generator means.

19. The apparatus according to claim 14 or 15 wherein the multiplier means comprises logic circuitry having the function $\overline{X}\cdot\overline{Y}+X\cdot Y$, where X and Y are the signals to the input of the multiplier means.

20. The apparatus according to claim 14 or 15 wherein the multiplier means comprises logic circuitry having the function $X\cdot\overline{Y}+\overline{X}\cdot Y$, where X and Y are the signals to the input of the multiplier means.

* * * * *